US005484272A

United States Patent [19]

Horn

[11] Patent Number: 5,484,272

[45] Date of Patent: Jan. 16, 1996

[54] ROTARY INTERNAL COMBUSTION ENGINE

[76] Inventor: Clarence G. Horn, R.R. 1, Box 2340, Urbana, Mo. 65767

[21] Appl. No.: 262,213

[22] Filed: Jun. 20, 1994

[51] Int. Cl.[6] ..... F01C 1/063

[52] U.S. Cl. ..... 418/35

[58] Field of Search ..... 123/245; 418/33, 418/35, 38

[56] References Cited

U.S. PATENT DOCUMENTS

| | | | |
|---|---|---|---|
| 1,196,028 | 8/1916 | Rozewski | 418/35 |
| 1,212,649 | 1/1917 | Krikorian | 418/35 |
| 1,224,642 | 5/1917 | Holmes | 418/35 |
| 1,318,017 | 10/1918 | Shank | 418/35 |
| 1,330,629 | 2/1920 | Gooding, Jr. . | |
| 1,481,220 | 1/1924 | Nichols . | |
| 3,144,007 | 8/1964 | Kauertz . | |
| 4,390,327 | 6/1983 | Picavet | 418/35 |

FOREIGN PATENT DOCUMENTS

| | | | |
|---|---|---|---|
| 696615 | 10/1930 | France | 418/35 |
| 15907 | 8/1911 | United Kingdom | 418/35 |

OTHER PUBLICATIONS

Rivals to the Wankel: A Roundup of Rotary Engines, Popular Science, Jan. 1967, pp. 80–85.

*Primary Examiner*—Michael Koczo
*Attorney, Agent, or Firm*—Klaas, Law, O'Meara & Malkin

[57] ABSTRACT

This application discloses an internal combustion engine comprising a hollow cylindrical body member, two pairs of vanes mounted in said body member for rotation coaxially therewith, whereby to divide the body member into four chambers, the vanes of each pair being diametrically opposite each other, and said pairs having limited rotatability with respect to each other, means permitting rotation of each pair of vanes in one direction only, a rotary power output member connected to each of said vane pairs to be driven thereby by either vane pair as it turns, and a coaxial, gearless, crankless phasing system, said body member having an inlet port for admitting an explosive air-gas mixture as each chamber reaches an angular position diametrically opposite to that at which said mixture was admitted thereto, said chamber having an exhaust port spaced angularly in front of said inlet port by a degree equal to the minimum angular extent of each of said chambers.

10 Claims, 6 Drawing Sheets

| | DRIVEN VANES | DEGREES OF ROTATION OF VANE SET 'A' | DEGREES OF ROTATION OF VANE SET 'B' | DEGREES OF ROTATION OF POWER OUTPUT MEMBER |
|---|---|---|---|---|
| Fig. Set 8 | A | 0 | 0 | 0 |
| Fig. Set 9 | B | 45 | 0 | 45 |
| Fig. Set 10 | A & B | 90 | 0 | 90 |
| Fig. Set 11 | B | 135 | 45 | 135 |
| Fig. Set 12 | B | 135 | 90 | 180 |
| Fig. Set 13 | A & B | 135 | 135 | 235 |
| After next 45 degrees (1/2 rev. of engine) | A | 180 | 180 | 270 |

FIG. 14

ROTARY INTERNAL COMBUSTION ENGINE

BACKGROUND

This invention relates to new and useful improvements in rotary internal combustion engines, and more specifically, to the simple and efficient phasing thereof with a strong, durable mechanism.

In explosive engines of the rotary type it is the universal experience that gear and crank phasing of the engine is highly objectionable, as it is difficult or impossible to so construct and arrange the gears and cranks as to enable them to withstand the excessive shocks to which they are subjected by the sudden impulses imparted to the mechanism by the explosive character of the motive power. Moreover, it is disadvantageous to support any part of the phasing mechanism in independent bearings which are out of line with the common axis of the piston chamber and the driven power output member. Most rotary internal combustion engines are open to objections of this type.

This invention eliminates the above cited problem by eliminating non-axial gear and crank mechanisms, replacing them instead with a coaxial cam phasing system which is strong and durable, yet simple and efficient.

SUMMARY

The invention comprises a hollow cylindrical body with four vanes disposed radially and rotatably therein, the vanes being relatively fixed in diametrically opposite pairs to divide the body member into four segmental chambers, with the two pairs having limited rotatability with respect to each other to increase the angular extent of two opposite chambers while simultaneously decreasing the angular extent of the other two chambers. By means of overrunning clutches, the two vane pairs are restricted to rotation in said body member in one direction only, and are operable to drive a rotary power output member in the same direction. Phasing of the engine is accomplished with the use of two sleeve like cams, the first being fixed to the first vane set and the second being fixed to the second vane set. Each sleeve like cam is coaxial with the power output member. The operable surfaces of the sleeve like cams face each other along the axis of the power output member. At least one longitudinal cam, having a boss in wiping contact with the axis of said power output member, and slidable between first and second limits along the axis of said power output member, is positioned between said sleeve like cams such that the boss or bosses alternately engage the operable surfaces of each sleeve like cam. The size and shape of teeth or other projections formed on the sleeve like cams control the relative phasing of the two vane sets. The body member has an inlet port for explosive air-gas mixture, an exhaust port for expended gasses, and a spark plug, all distributed peripherally thereabout.

When rotary action of the vanes is initiated by a starter or the like, each chamber is subjected successively to firing, exhausting, recharging and compression, the vane pairs being alternately fixed and driven. The power output member is driven alternately, but continuously, first by one vane pair and then by the other. No valving of the conventional sort is required.

It is therefore a primary object of this invention to provide new and useful improvements in rotary internal combustion engines, particularly a gearless, crankless phasing system.

It is a further object of this invention to provide a phasing system for rotary engines which is strong and durable.

It is yet another object of this invention to provide a phasing system for rotary engines which is easy to manufacture, requiring few parts.

It is also an object of this invention to provide a phasing system which eliminates the need for non-coaxial elements.

It is another important object of this invention to disclose a rotary engine capable of making efficient use of the herein described phasing system.

Finally, it is notable that the disclosed engine and phasing system is able to handle higher horsepower without part breakage.

BRIEF DESCRIPTION OF THE DRAWINGS

These and other features, aspects and advantages of the present invention will become better understood with regard to the following description, appended claims and accompanying drawings wherein:

FIGS. 8A–13A represent the relative positions of the engine's vanes at successive stages of operation, viewed from the same perspective as the vanes in FIG. 2.

FIGS. 8B–13B represent the engine's phasing system in successive stages of operation, viewed from the same perspective as the phasing system in FIG. 5, and respectively corresponding with the vane positions of FIGS. 8A–13A.

FIG. 14 is a table showing which vane pair is about to be driven and the degrees of rotation of each vane pair for each of the figure sets in FIGS. 8–13.

DESCRIPTION OF THE PREFERRED EMBODIMENT

Figure 1:
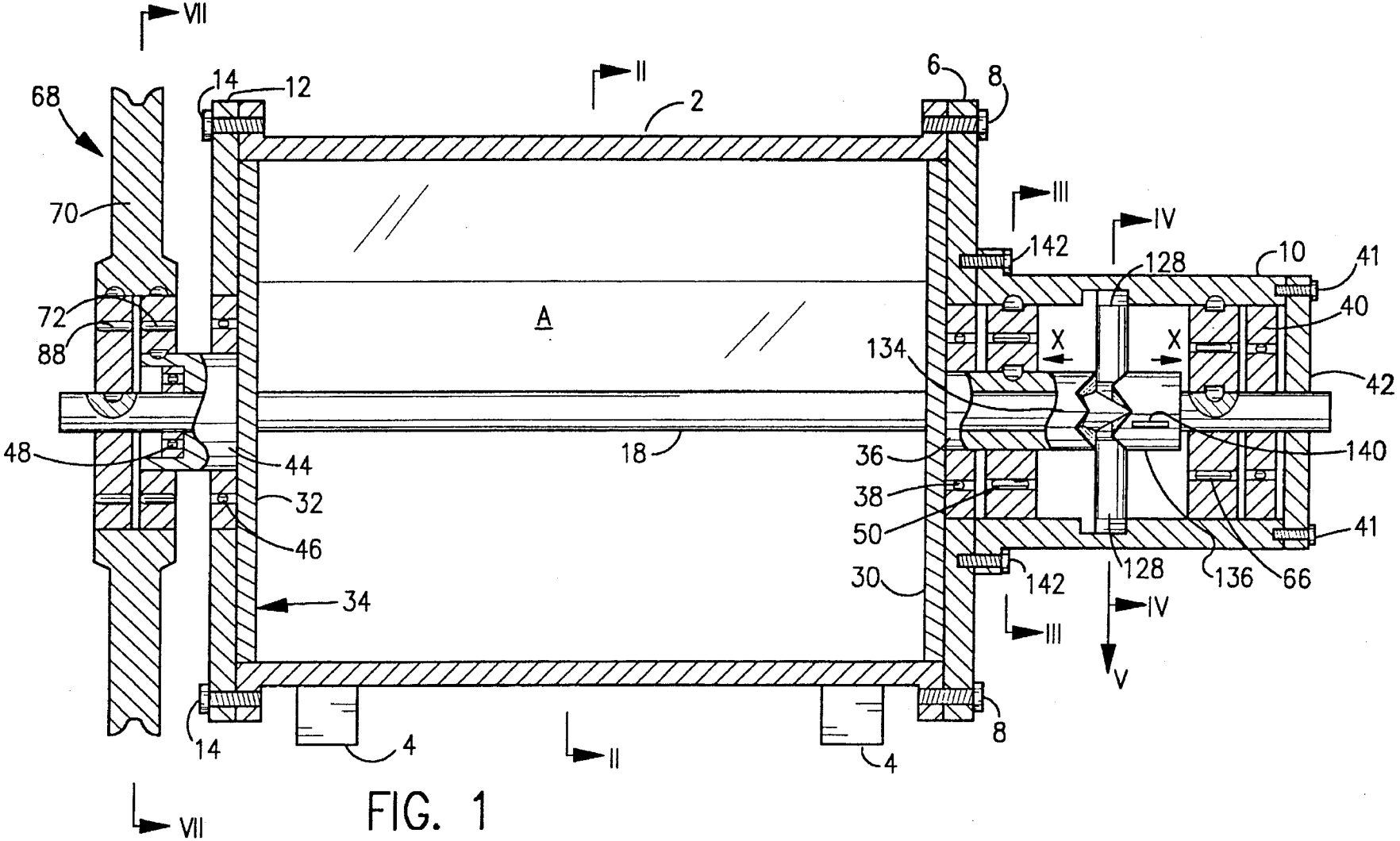
FIG. 1 is a slightly irregular longitudinal sectional view of a rotary internal combustion engine embodying the principles of the present invention.
Figure 2:
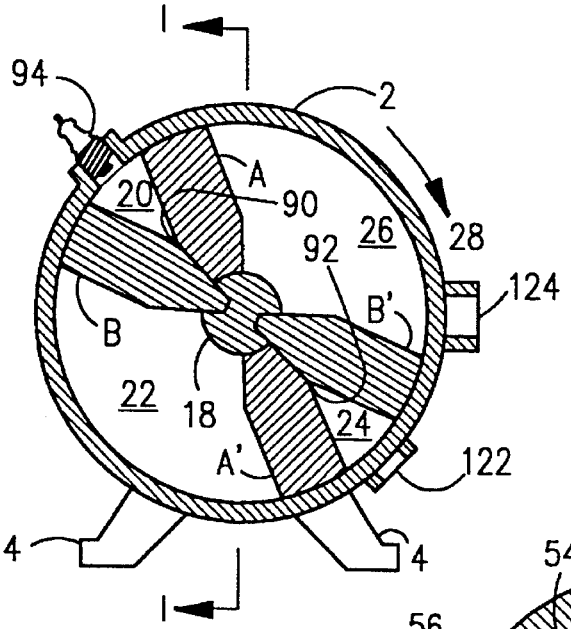
FIG. 2 is a cross sectional view taken along line II—II of FIG. 1.

FIG. 1 portrays a rotary internal combustion engine 1 comprising a hollow cylindrical body member 2 with a horizontal axis. Integral lugs 4 provide rigid supports for mounting. One end of said body member is closed by an end plate 6 secured thereto by bolts 8. A reduced tubular extension 10, coaxial with the body member, is attached to end plate 6 with bolts 142. The opposite end of the body member is closed by an end plate 12 secured thereto by bolts 14. A drive shaft 18 is disposed axially in the body member, and extends outwardly through the end plates. Four essentially planar vanes A, B, A' and B' are disposed radially in the body member, dividing the interior of said body member into four segmental chambers 20, 22, 24 and 26 as shown in FIG. 2, the chamber intermediate vanes A and B being designated 20, the chamber intermediate vanes B and A' being designated 22, the chamber intermediate vanes A' and B' being designated 24, and the chamber intermediate vanes B' and A being designated 26. Drive shaft 18 rotates in the direction of arrow 28 in FIG. 2, or in a clockwise direction looking to the right in FIG. 1.

Vanes A and A' (vane set A) extend in diametrically opposite directions from shaft 18, each being fixed at its side or radial edges respectively to a pair of discs 30 and 32. Said discs are concentrically disposed in the body member in rotatable engagement with end plates 6 and 12, and their peripheral edges are in wiping contact with the inner periphery of body member 2. Vanes A and A' have wiping contact at their inner edges with shaft 18, and at their outer edges with the inner periphery of body member 2. Vanes A and A', together with discs 30 and 32, form a unitary reel designated generally by number 34. Vanes B and B' (vane set B) are also disposed in diametrically opposite directions from drive shaft 18, being fixed at their inner edges in said shaft, and having wiping contact at their outer edges with the inner peripheral surface of body member 2. The side or radial edges of vanes B and B' have wiping contact with discs 30 and 32. Suitable seals, not shown, may be provided along all of said lines of wiping contact of the vanes so as to prevent leakage.

Disc 30 is provided with an integral tubular hub 36 projecting coaxially into extension 10, and is supported rotatably therein by ball bearing 38. Shaft 18 extends through a hole provided therefor in disc 30, through hub 36, and is supported rotatably in extension 10 by ball bearing 40, said ball bearing being secured in place in extension 10 by plate 42 and bolts 41.

Figure 3:
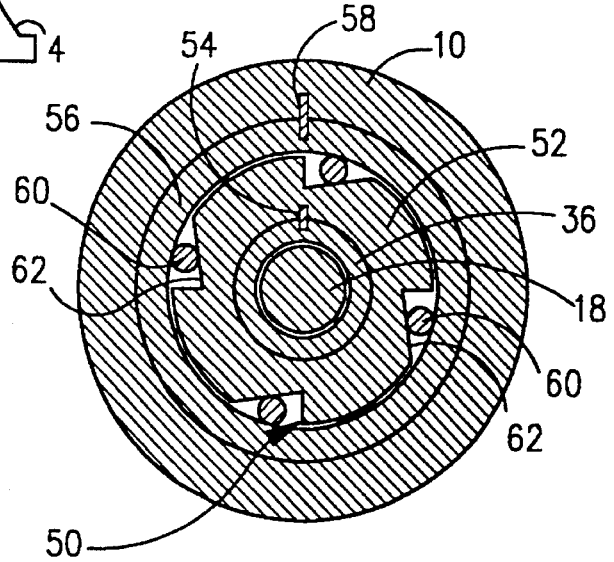
FIG. 3 is a cross sectional view taken along line III—III of FIG. 1.

Interposed between hub 36 of disc 30 and extension 10 of end plate 6 is an overrunning clutch 50 of the Sprague type, consisting as best shown in FIG. 3 of an inner race 52 secured to hub 36 by key 54, an outer race 56 secured in extension 10 by key 58, and a plurality of rollers 60 interposed between said races with their axes parallel to shaft 18, and spaced regularly about the circumference thereof. The inner surface of outer race 56 is smooth and cylindrical, and is engaged by rollers 60. Each roller is engaged in a tapered notch 62 formed in inner race 52, the base of said notch being inclined acutely to the plane of tangency of the roller with the outer race. Thus it will be seen that reel 34 can rotate in a clockwise direction as viewed in FIG. 3, rollers 60 tending to be rolled toward the deeper ends of notches 62. However, any tendency of the reel to rotate in the opposite direction, counter-clockwise as viewed in FIG. 3, is immediately arrested by the tendency of the rollers to roll toward the shallow ends of the notches, and consequent wedging thereof between the races. Similarly, a second overrunning clutch 66 (see FIG. 1) is interposed between shaft 18 and extension 10 of end plate 6, and is operable to permit unidirectional rotation of said shaft in the same direction as reel 34.

Figure 4:
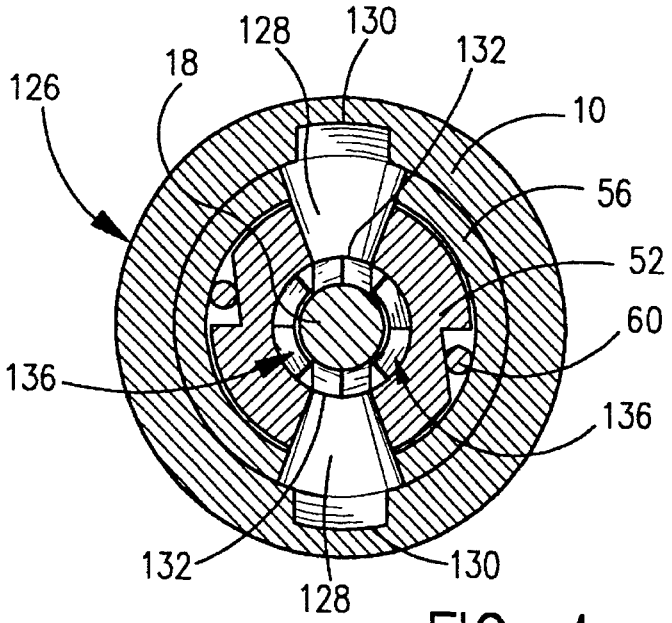
FIG. 4 is a cross sectional view taken along line IV—IV of FIG. 4.
Figure 5:
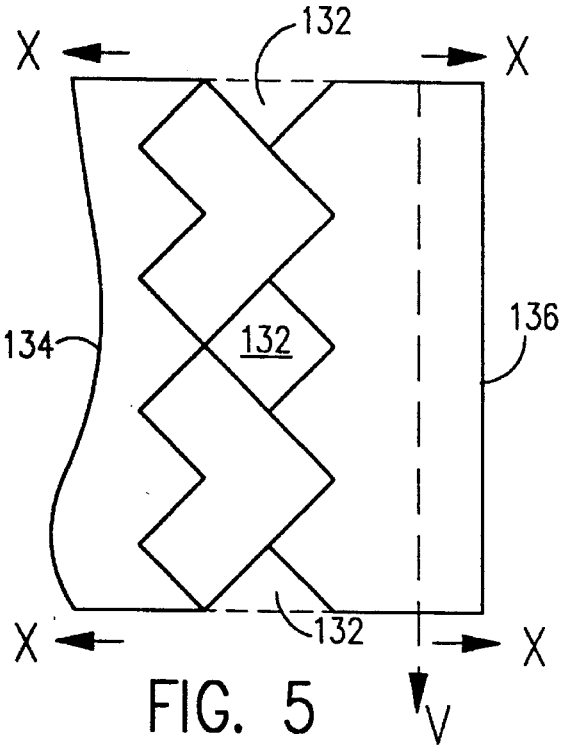
FIG. 5 is a radial view of the engine's phasing system along line V in FIG. 1, the phasing system being split along line X—X of FIG. 1 and laid flat.
Figure 6:
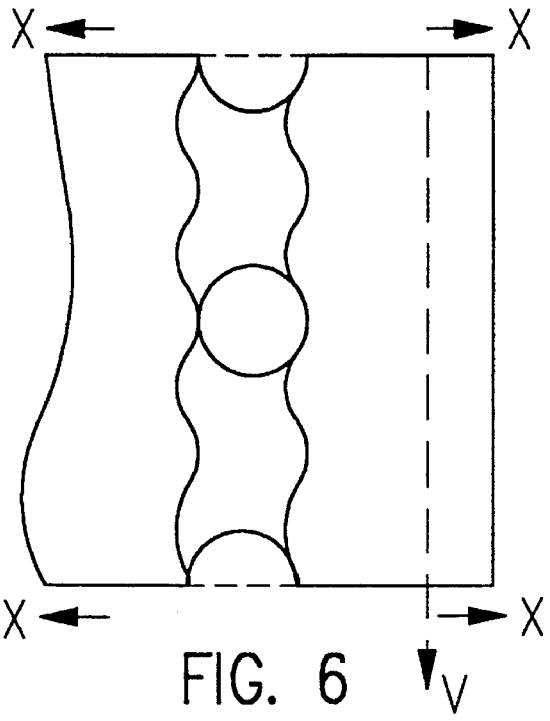
FIG. 6 is an alternate embodiment of the phasing system shown in FIG. 5.

Interposed between said overrunning clutches 50 and 66 is a phasing system 126 for controlling the relative angular positions of vanes A, B, A' and B'. Said phasing system comprises longitudinal cams 128, slidably mounted in recesses 130 of extension 10, as is best seen in FIGS. 1 and 4. The inner surfaces of cams 128 are molded to form bosses 132 which engage portions of the circumference of shaft 18 in wiping contact (FIG. 4). As will be seen below, rotation of the engine will cause cams 128 to slide horizontally along shaft 18 between first and second limits defined by the boundaries of recesses 130. The frictional fit of cams 128 against recesses 130 and shaft 18 prevents unwanted horizontal sliding of cams 128 (i.e. sliding due to vibration or other forces which are not specifically due to rotation of the engine). Means for varying or adjusting the frictional sliding resistance of cams 128 may be added if so desired. Several such means are available in the prior art and will not be described further. The circumference of the outermost end of hub 36 comprises a sleeve like cam 134 which continuously engages bosses 132 of longitudinal cams 128. The sides of bosses 132, opposite the sides engaging cam 134, are engaged by a second sleeve like cam 136 which is attached to shaft 18 with key 140. In FIG. 5, the engine's phasing system has been split along line X-X of FIG. 1 and laid flat along line V. The phasing system shown therein comprises sleeve like cams 134 and 136 with rings of triangularly shaped teeth (shown as isosceles teeth), and generally square (rhombodial) bosses 132. Each sleeve like cam comprises four teeth, such that each tooth spans a distance equal to ninety degrees of the circumference of the cam. The distance, in degrees, which a tooth spans will be coined circumferential width. The phasing of the cams in FIG. 5 corresponds to the vane positions in FIG. 2. FIG. 6 shows an alternative embodiment of the engine's phasing system wherein the edges of the sleeve like cams, and bosses, are elliptical. The elliptical cams and bosses are presumed to reduce wear over extended periods of use.

Figure 7:
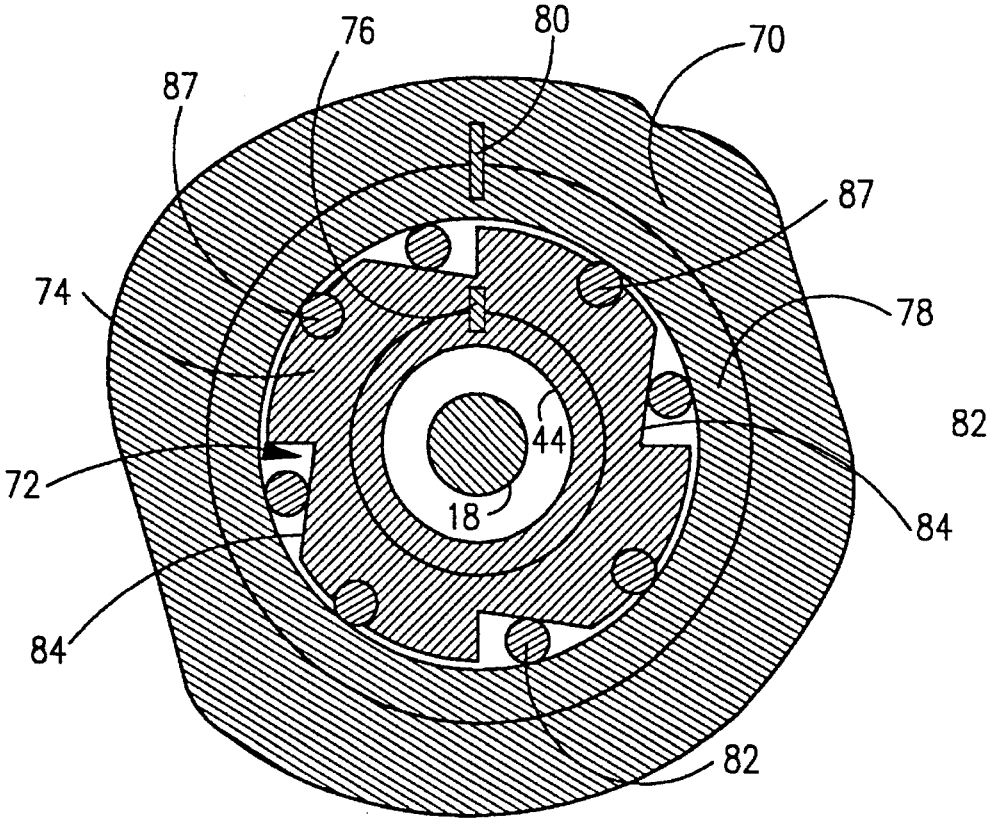
FIG. 7 is a cross sectional view taken along line VII—VII of FIG. 1.

A rotary power output member, here illustrated as a sheave wheel 68 about which a flexible belt may be guided for transmitting the power output of the engine to a load, is disposed outwardly from end plate 12 and coaxially with shaft 18, said sheave wheel having a hollow cylindrical hub 70. Interposed between hub 44 of disc 32 and wheel hub 70 is an overrunning clutch 72 similar to clutches 50 and 66 and including, as best shown in FIG. 7, an inner race 74 keyed to hub 44 by key 76, an outer race 78 keyed to hub 70 by key 80, and rollers 82 carried in tapered notches 84 of the inner race. Also, additional rollers 87 are interposed between inner race 74 and outer race 78, at angularly spaced intervals between clutch rollers 82, whereby the clutch serves the additional function of providing roller bearing support for sheave wheel 68 on hub 44. Another overrunning clutch 88, similar in all respects to clutch 72, is interposed between shaft 18 and wheel hub 70. The inclination of notches 84 of clutches 72 and 88 is such that as either reel 34 or shaft 18 rotates in a clockwise direction, looking to the right in FIG. 1, they will cause wheel 68 to turn in the same direction. Furthermore, said wheel can continue to turn in the same direction if rotation of either the reel or the shaft is arrested.

Since reel 34 and shaft 18 can rotate independently, to a degree, it will be seen that the angular extent of chambers 20, 22, 24 and 26 can be changed, but that the degree of rotatability of the shaft and reel is limited by engagement of the vanes. In FIG. 2, chambers 20 and 24 have their minimum angular extent, while chambers 22 and 26 are shown at their maximum angular extent. Any attempt, for example, to move vane B closer to vane A results in abutment of the inner edges of said vanes along line 90, and the abutment of vane B' with vane A' along line 92, so that the trailing vanes push the leading vanes ahead of them. This general configuration of the vanes is referred to as a locked position.

Mounted in the cylindrical wall of body member 2, at one point of the periphery thereof, is a spark plug 94 operable whenever energized to emit a spark to ignite an explosive air-gas mixture in any chamber of the engine aligned therewith. The operation of said spark plug is controlled by a timing mechanism (not shown). Such mechanism is not necessary for an understanding of the present invention.

At a point diametrically opposite from spark plug 94, body member 2 is provided with an inlet port 122 for an explosive mixture, which may be supplied from a fuel source (not shown). Said body member is also provided with an exhaust port 124, said exhaust port angularly preceding the inlet port, considering the direction of rotation of the engine, by an angle substantially equal to the width of a vane.

Figure 8A:
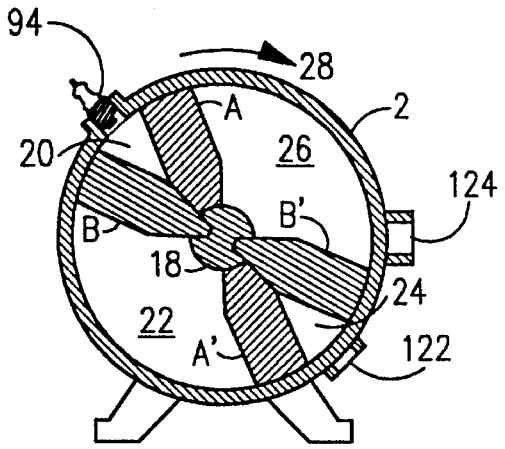
Figure 8B:
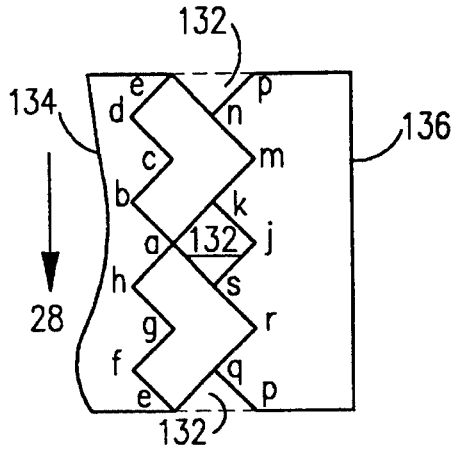
Figure 9A:
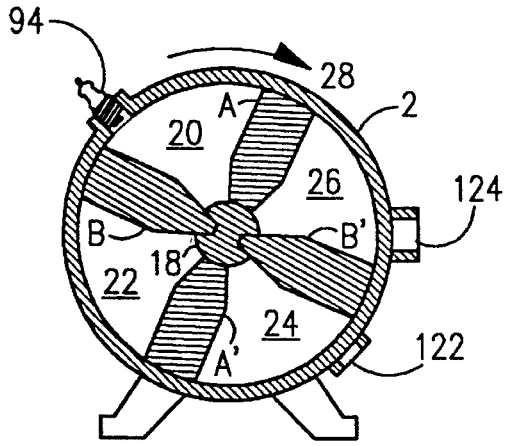
Figure 9B:
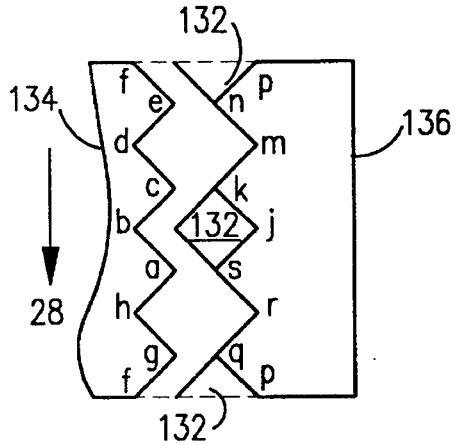
Figure 10A:
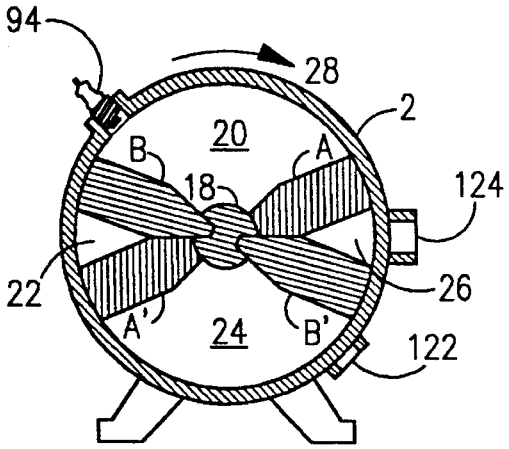
Figure 10B:
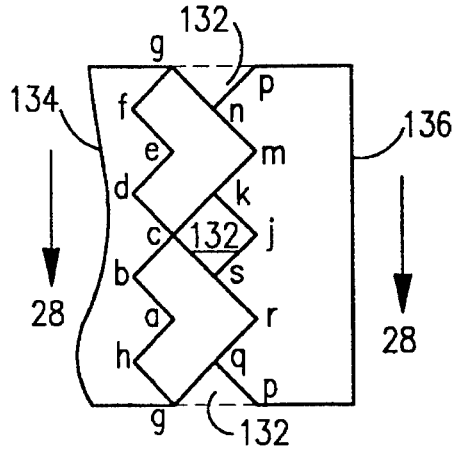
Figure 11A:
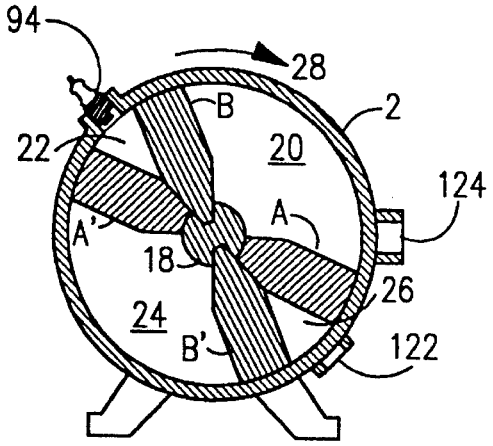
Figure 11B:
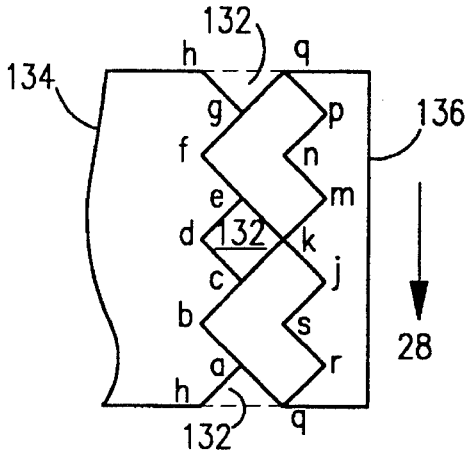
Figure 12A:
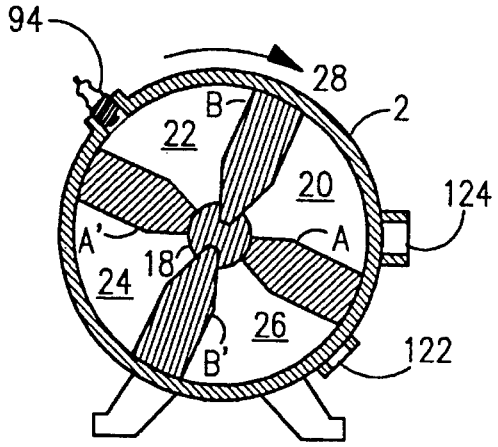
Figure 12B:
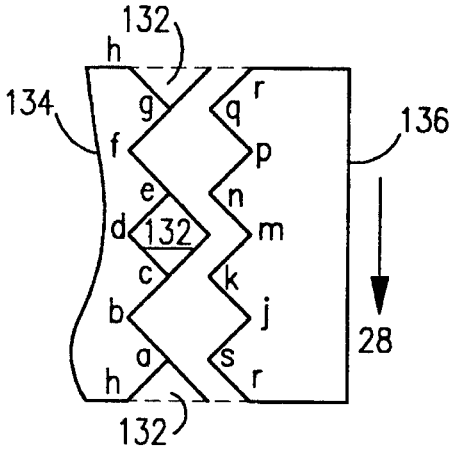
Figure 13A:
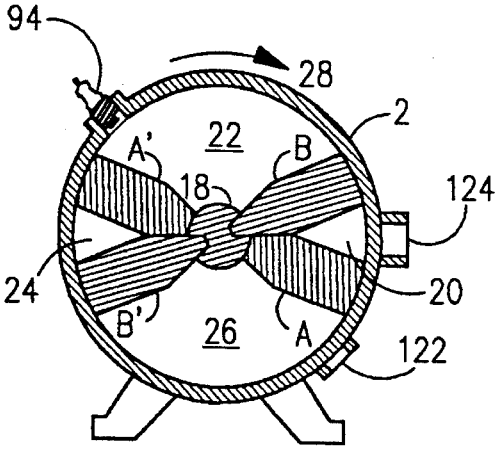
Figure 13B:
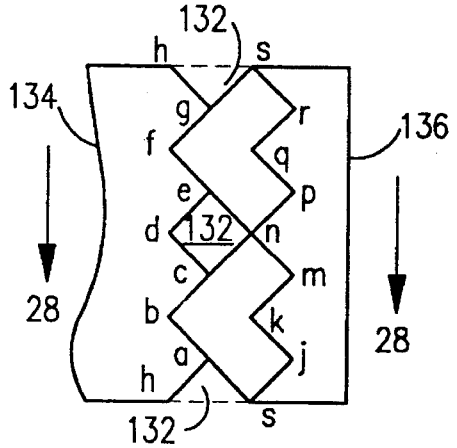

To facilitate description of the operation of the engine, let it be assumed that the vanes have the positions shown in FIGS. 2 and 8A, chambers 20 and 24 having their minimum angular extent and being aligned respectively with spark plug 94 and intake port 122, while chambers 22 and 26 have their maximum angular extents, with chamber 26 aligned with exhaust port 124. Additionally, let it be assumed that the positions of the engine's phasing system components shown in FIG. 8B correspond with the positions of the vanes shown in FIG. 8A. Note that bosses 132 are at their rightmost positions as viewed looking at FIGS. 1 and 8B. Let it further be assumed that chamber 20 is at this moment filled with a compressed, explosive air-gas mixture, that chamber 26 is occupied by the spent gasses of a previous firing, that chamber 24 is fully exhausted, and that chamber 22 is occupied by an uncompressed explosive air-gas mixture. Finally, assuming that all of the vanes are advancing simultaneously in the direction of arrow 28, it will be seen that at this moment the engine's timing mechanism causes plug 94 to emit a spark to ignite the compressed mixture in chamber 20. The expansive force resulting from this ignition causes vane A to be advanced in the direction of arrow 28. Vane A can advance since said vane is a part of reel 34, and rotation of the reel in that direction is permitted by clutch 50, as previously described. At the same time, the turning of Vane A in direction 28 causes cam 134 to also rotate in direction 28. Also, as vane A advances to rotate the reel, it turns sheave wheel 68 through clutch 72, providing a power output. The firing of chamber 20 also tends to turn vane B in a direction opposite to arrow 28, but it cannot turn in this direction since it is affixed to shaft 18, and said shaft is locked against rotation in this direction by clutch 66. Therefore, vanes B and B' remain stationary. Likewise, cam 136 is locked in a stationary position. Nevertheless, sheave wheel 68 can still be driven by the reel, despite the locking of the shaft, since clutch 88 is then "freewheeling".

Further operation of the engine is best understood with the aid of sequential figure sets 8–13. FIGS. 8A–13A show successive positions of the engine's vanes, while FIGS. 8B–13B show successive positions of the engine's phasing system corresponding to FIGS. 8A–13A. Operation of the engine and its phasing system is examined in 45 degree increments of vane rotation. After the initial firing, vane A advances from the position shown in FIG. 8A to the position shown in FIG. 9A. Vane B remains stationary due to clutch 50. Note that the movement of vane set A—A' forces spent gasses (exhaust) through port 124, and draws an appropriate air-gas mixture through port 122, either by vacuum effect or an injection process. Movement of vane A' also begins to compress the air-gas mixture contained between vanes A' and B. As vane A turns, cam 134 advances 45 degrees to the position shown in FIG. 9B. The frictional fit of longitudinal cams 128 and bosses 132 insures that bosses 132 remain at their rightmost positions. As vane A continues to move in direction 28, vane A advances to the position shown in FIG. 10A. Simultaneously, cam 134 advances another 45 degrees to the position shown in FIG. 10B. Bosses 32 again remain at their rightmost positions. Cam 136 remains stationary. At this point, vane A is adjacent to vane B', and the two vane sets are "locked". Consequently, the vanes turn in unison through the next 45 degrees of rotation. Note that at this point in time, all spent gasses have been expelled from chamber 26. As the vanes turn in unison, chamber 22 is sealed off from inlet port 122, and chamber 20 is now connected with exhaust port 124. Expulsion of spent gasses from the previous combustion cycle releases pressure against the leading face of vane B which had previously held that vane in a stationary position. Additionally, compression of the air-gas mixture in chamber 22 applies pressure against the trailing side of vane B. Cams 134 and 36 also move in unison, and the teeth of cam 136 force bosses 132 to the left. During this 45 degree rotation, one cycle of ignition, exhaustion and compression is completed. The A vane set has now revolved 135 degrees and the B vane set has revolved 45 degrees. See FIG. 14. Sheave wheel 68 has been driven via clutch 72 through 135 degrees of rotation by the A—A' vane pair.

The engine is now in position for a second firing of spark plug 94. Upon a second firing, the B vane set travels through a rotation identical to that which vane set A just travelled. See FIGS. 11A—13A. Rotation of vane set B will cause rotation of cam 136 in a direction similar to that just traveled by cam 134. Note that bosses 132 remain in their leftmost positions through this second combustion cycle. After vane set B has rotated ninety degrees from its firing position, the two vane sets will once again become locked and will travel forty-five degrees in unison. Bosses 132 move back to the right.

It will be noted in the table of FIG. 14 that each vane set has now revolved 180 degrees. However, the power output member has been driven 135 degrees by each of the vane sets. Thus, a 180 degree revolution of the engine components will impart 270 degrees of rotation to the power output member, thereby yielding a 50% gain in power output.

The third and fourth cycles of the engine are in all ways identical to the first and second, but for chambers 24 and 26 now serving as combustion chambers and vanes A' and B' being the driven vanes.

I claim:

1. A phasing system for a rotary internal combustion engine having first and second vane pairs rotatable around a common drive shaft having a given circumference and extending axially through a cylindrical body member which encloses said vanes and sections the engine into four angularly adjustable chambers, said engine further comprising overrunning clutches to ensure that said drive shaft is rotatable in one direction only by one or both vane pairs, comprising:

a. a first sleeve like cam, rigidly attached to said first vane pair and coaxial with said drive shaft, said cam having an operable surface extending radially and coaxially to said drive shaft;

b. a second sleeve like cam, coaxial with said drive shaft and rigidly interconnected to said second vane pair via said drive shaft, said cam having an operable surface extending not only radially and coaxially to said drive shaft, but also facing the operable surface of said first sleeve like cam; and c. at least one longitudinal cam having a boss in wiping contact with said drive shaft, slidable between first and second limits along the axis of said drive shaft, and positioned between said sleeve like cams such that said boss engages the operable surfaces of each sleeve like cam.

2. A phasing system as in claim 1, wherein said operable surfaces of said sleeve like cams comprise four triangular teeth, and said boss or bosses are rhomboidal in shape.

3. A phasing system as in claim 2, wherein said teeth are equal in circumferential width.

4. A phasing system as in claim 2, wherein said teeth comprise isosceles teeth.

5. A phasing system as in claim 3, wherein said circumferential widths of said teeth are each equal to one-fourth the circumference of said drive shaft.

6. A phasing system as in claim 1, wherein said operable surfaces of said sleeve like cams comprise four elliptical projections, and said boss or bosses are elliptical in shape.

7. A phasing system as in claim 6, wherein said projections are equal in circumferential width.

8. A phasing system as in claim 6, wherein said projections are circular.

9. A phasing system as in claim 1, wherein said at least one longitudinal cam consists of two such cams, said longitudinal cams being positioned diametrically opposite each other along the axis of said drive shaft.

10. A phasing system as in claim 1, wherein said longitudinal cam boss or bosses have a circumferential width equal to one-fourth the circumference of said drive shaft.

* * * * *